US005555648A

United States Patent [19]

Griffin

[11] Patent Number: 5,555,648

[45] Date of Patent: Sep. 17, 1996

[54] PORTABLE DEVICE FOR DRYING AND REMOVING WRINKLES FROM CLOTHING

[76] Inventor: Robert D. Griffin, P.O. Box 3083, Brentwood, Tenn. 37024-3083

[21] Appl. No.: 527,187

[22] Filed: Sep. 12, 1995

[51] Int. Cl.[6] ..... F26B 13/00

[52] U.S. Cl. ..... 34/621; 223/67

[58] Field of Search ..... 34/621, 440, 442, 34/104, 106; 223/67, 73, 74

[56] References Cited

U.S. PATENT DOCUMENTS

| | | | |
|---|---|---|---|
| 245,361 | 8/1881 | Eavestaff | 223/67 |
| 1,570,508 | 1/1926 | Lungstras | 223/67 |
| 2,338,776 | 1/1944 | Miller | 223/70 |
| 2,417,838 | 3/1947 | Paris | 223/70 |
| 2,459,962 | 1/1949 | Richa et al. | 223/70 |
| 2,515,848 | 4/1948 | Winter | 223/67 |
| 3,165,244 | 1/1965 | Dosal | 223/67 |
| 3,184,127 | 5/1965 | Smith | 223/67 |
| 3,298,578 | 10/1967 | Shields | 223/67 |
| 3,429,489 | 2/1969 | Blevens | 223/67 |
| 3,739,492 | 6/1973 | Brooks | 34/163 |
| 4,819,812 | 4/1989 | Demarest, Jr. | 211/1.3 |
| 5,361,516 | 11/1994 | Dahman | 34/440 |

OTHER PUBLICATIONS

Method 5450, "Permeability To Air; Cloth; Calibration Orifice Method", Federal Test Method Std. No. 191A, U.S. Dept. of Defense, 1978.

*Primary Examiner*—John M. Sollecito
*Assistant Examiner*—Steve Gravini
*Attorney, Agent, or Firm*—William R. Sharp

[57] ABSTRACT

A portable device is provided for drying and removing wrinkles from an article of clothing. The device is for use with a portable dryer of the type having a handle, internal fan, and nozzle from which heated air is blown. The device comprises an inflatable member capable of being hung and having a body portion comprised of an air permeable fabric, a sealing member for sealingly engaging the nozzle so that the nozzle is in communication with the interior of the inflatable member, and a fastener for securing the portable dryer in a fixed position relative to the inflatable member. The inflatable member is maintained in an inflated state by a continuous flow of heated air from the nozzle of the dryer. According to one aspect of the invention, the body portion of the inflatable member fits within and in contact with the article of clothing. According to another aspect, a flexible member has a jacket portion which is shaped and sized to allow at least one article of clothing to be positioned and removably secured between it and the body portion of the inflatable member.

20 Claims, 3 Drawing Sheets

PORTABLE DEVICE FOR DRYING AND REMOVING WRINKLES FROM CLOTHING

BACKGROUND OF THE INVENTION

The invention relates to the field of clothes drying and finishing (i.e. wrinkle removal), and more particularly to a portable device for drying and removing wrinkles from clothing.

There has long been a need for a highly portable device which is effective in drying and removing wrinkles from clothing. This need applies in particular to travelers, who typically hand wash clothing in a sink, and then drip dry the wet clothing. Drip drying is very time consuming, and typically leaves clothing articles wrinkled.

Prior attempts to solve this problem are disclosed in U.S. Pat. No. 3,739,492 of Brooks and U.S. Pat. No. 5,361,516 of Dahman. Each of these patents pertain to clothes dryers that are portable and suitable for use while traveling.

The device of the Brooks patent employs an inflatable, air impervious bag and a special fan for inflating and blowing a current of air over clothes hung inside the bag. Although the clothing may be dried more quickly than simply drip drying, wrinkles will remain in the dried clothing. Moreover, this device is somewhat portable, but requires the traveler to pack the fan as well as the bag, thereby contributing to the bulk of the device.

The device of the Dahman patent employs an impermeable member that fits within the waist opening of the pants, clamps for closing the pant legs, and a portable hair dryer for blowing air through an opening in the member and into the interior of the pants. The pants are accordingly inflated so that air passes through the pores of the pants. Although this device may effectively dry and remove wrinkles from a pair of pants, and uses a portable hair dryer which the traveler would ordinarily pack for hair drying, it cannot be used with any article of clothing other than a pair of pants. Therefore, the utility of this device is highly limited.

SUMMARY OF THE INVENTION

It is, therefore, an object of the invention to provide a device for drying and removing wrinkles from clothing that is adaptable for use with virtually any type of clothing article, and which uses a portable hair dryer of the type normally used for drying hair. This type of portable dryer is characterized by a handle, an internal fan, and a nozzle from which heated air is blown.

The above object is achieved by a portable device for use with a portable dryer of the above-mentioned type, having a handle, internal fan, and nozzle from which heated air is blown, wherein the device comprises: an inflatable member, capable of being hung in at least one hanging orientation, having an opening in communication with the interior of the inflatable member, and further having a body portion comprised of an air permeable fabric which has an exterior surface and which is sized and shaped to fit within an article of clothing; a sealing means associated with the opening for sealingly engaging the nozzle so that such nozzle is in communication with the interior of the inflatable member through the opening; a fastener means, fixedly connected to the inflatable member or the sealing means, for securing the portable dryer in a fixed position relative to the inflatable member at the same time that the sealing means is in engagement with the nozzle and the inflatable member is in a hanging orientation; wherein the fabric has an air permeability that permits inflating the inflatable member to an inflated state and maintaining such inflated state by means of a continuous flow of heated air into the interior of the inflatable member from the nozzle of the portable dryer, when the nozzle is in sealed engagement with the sealing means and is secured in position by the fastener means, whereby the inflatable member in said hanging orientation with its body portion within the article, and as maintained in the inflated state, has the exterior surface of its body portion in contact with the interior surface of the article so as to effectively dry and remove wrinkles from the article. Of course, the inflatable member can be of any shape or size to dry and remove wrinkles from any article of clothing, such as a shirt, pair of pants, etc.

According to another aspect of the invention, there is provided a portable device for use with a portable dryer of the above-mentioned type, having a handle, internal fan, and nozzle from which heated air is blown, wherein the device comprises: an inflatable member, capable of being hung in at least one hanging orientation, having an opening in communication with the interior of the inflatable member, and further having a body portion which comprises an air permeable fabric; a sealing means and fastener means like that described above; a flexible member having a connecting portion for providing a connection to the inflatable member and an air permeable jacket portion which is shaped and sized to allow, when the inflatable member is in an inflated state, at least one article of clothing to be positioned and removably secured between the jacket portion and the body portion with at least one surface of the article in contact with the exterior surface of the body portion; wherein the fabric has an air permeability that permits inflating the inflatable member to the inflated state and maintaining such inflated state in the manner described above, whereby the inflatable member in said hanging orientation and as maintained in its inflated state effectively dries and remove wrinkles from the article secured between the jacket portion and body portion. This aspect of the invention can be used to dry and remove wrinkles from any article of clothing that can fit between the jacket portion of the flexible member and the body portion of the inflatable member, but is particularly applicable to miscellaneous articles such as shorts, underwear, socks, etc.

According to either aspect of the invention described above, the fabric of the body portion is preferably a light weight fabric, such as nylon, that can be folded easily. As folded, the device occupies little space, thereby optimizing its portability. Furthermore, the device is highly effective in quickly drying and removing wrinkles from articles of clothing. Therefore, the device is not only useful in traveling, but also at home when only one or several articles of clothing need to be dried, or when the article being dried is very delicate and subject to damage in a conventional clothes dryer. The device is also highly suitable for use in a small apartment or dormitory room where space does not permit a conventional clothes dryer.

DETAILED DESCRIPTION OF THE INVENTION

Before turning to a description of preferred embodiments of the invention with reference to the FIGURES, a term must first be defined. As used herein and in the appended claims, the term "air permeability", as applied to a fabric, refers to that parameter as measured according to Method 5450, "Permeability to Air; Cloth; Calibrated Orifice Method", Federal Test Method Std. No. 191A, U.S. Department of Defense, 1978, which is hereby incorporated by reference. The term "cloth", as used in such test method, is considered to be interchangeable with the term "fabric", as is used herein and in the appended claims.

Figure 1:
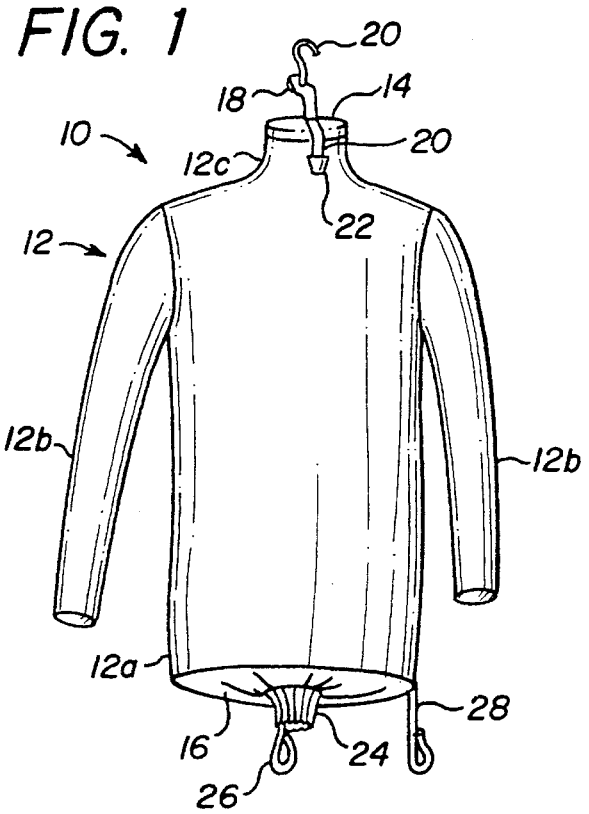
FIG. 1 is a rear view of one embodiment of the invention having an inflatable member in the shape of a shirt and shown in an uninflated state.

Referring now to FIG. 1, the illustrated embodiment includes an inflatable member 10 having a body portion 12 and opposing ends 14 and 16 between which the body portion extends. As shown, body portion 12 has a torso 12*a*, arms 12*b*, and neck 12*c*, and is accordingly shaped and sized to fit within a shirt. With regard to size, body portion 12 is preferably sized to be slightly larger than most shirts so that such body portion will occupy the total volume of almost any shirt (i.e. adult size) when in an inflated state. Body portion 12 comprises an air permeable fabric, further discussed below, which will simply fold over itself if the body portion is slightly larger than the shirt. This is not detrimental to the desired result of a dried and wrinkle-free shirt. Ends 14 and 16 also preferably comprise a fabric which is sewn to the fabric of body portion 12 by means of internal seams.

The fabric of body portion 12 is preferably woven and comprised of fibers that can withstand temperatures of up to about 200° F. without melting, softening, or otherwise decomposing. Suitable fibers include nylon, polyester, cotton or other natural fibers, and blends thereof. Nylon fibers are particularly preferred as being substantially mildew resistant, highly flexible, capable of desirably tight weave patterns, and highly tolerant of temperatures encountered during use. The fineness of the fibers is preferably in the range of about 20 to about 70 denier.

The fabric of body portion 12 is further preferably characterized by a rip stop weave pattern, a weight of about 0.5 to about 6 oz/yd$^2$ (ounces per square yard) and most preferably about 1 to about 2 oz/yd$^2$, a thickness of about 0.002 to about 0.15 inch, and most importantly, an air permeability of no more than about 100 ft$^3$/min/ft$^2$ (cubic feet of air per minute per square foot of fabric). For most applications employing about 15 to 30 ft$^2$ of fabric for adult size clothing, it is generally preferred that the air permeability is no more than about 10 ft$^3$/min/ft$^2$, more preferably no more than about 3 ft$^3$/min/ft$^2$, and most preferably about 1 to about 3 ft$^3$/min/ft$^2$. As the size of the inflatable member is decreased, the air permeability is preferably increased to maintain the desired inflated state, further discussed below, assuming a constant flow rate of air into the inflatable member. Therefore, for a child or infant size inflatable member, increasing the air permeability to above 10 ft$^3$/min/ft$^2$ may be desirable.

To achieve an air permeability of no more than 10 ft$^3$/min/ft$^2$, a greige (raw and untreated) fabric must normally be treated to reduce its air permeability to the desired level. A preferred method of reducing air permeability involves the conventional and known method of calendering under heat and pressure. According to such a method, the greige fabric is scoured, rinsed, dried and heat set to stabilize the fabric, and then calendered to achieve the desired air permeability. Calendering is typically carried out between two or more heated rollers with high pressure exerted on the fabric to partially close off pores in the fabric. The speed at which the fabric is fed between the rollers, the pressure, and roller temperature each affect the resulting air permeability, as well as the finish, strength, etc. During the calendering process, a filler such as talc can be added to further reduce air permeability. However, air permeability tends to destabilize over time when such fillers are used. An optional flurocarbon or other DWR (Durable Water Resistant) finish provides moisture and stain resistance, and contributes to air permeability stability.

As an alternative to calendering, a vinyl, urethane, acrylic, rubber, or silicone coating can be applied to a greige fabric in carefully controlled amounts to reduce air permeability to the desired level.

Although the fabric of ends 14 and 16 may be the same as the fabric for body portion 12, the end fabric preferably has a lower air permeability and higher weight than the body portion fabric. A lower air permeability is desirable since ends 14 and 16 do not perform a drying and wrinkle removal function, and a heavier weight is desirable because of the fact that the ends have other weight-supporting device components connected thereto (as will be more apparent below). An air permeability of near zero is preferred, as can be achieved through application of coatings such as urethane or silicone. A weight of at least about 2 oz/yd$^2$ is also preferred. Any weave pattern can be employed, such as rip stop, taffeta, or even oxford cloth. If desired, the ends of arms 12*b* could also be comprised of this type of fabric.

At end 14 is a strap 18 of, for example, Mylar® polyester film (available from DuPont) or vinyl, having one end fixedly connected to end 14 and an opposing free end for receiving therethrough a hook 20. Hook 20 can be used for hanging inflatable member 10, as is shown in subsequent FIGURES. Another strap 20, similar to strap 18, has one end also fixedly connected to end 14 and an opposing free end having a clip 22 fastened thereto. The purpose of clip 22 in using the illustrated embodiment will be discussed below.

At end 16 is a flexible nozzle cuff 24 having one end connected to end 16 and an opposing free end. Cuff 24 is adapted to receive a nozzle of a portable dryer, and preferably comprises a knitted elastic fabric composed of, for example, acrylic, polyester, cotton, or combinations thereof interwoven with elastic fibers such as spandex fibers. The free end and a substantial portion of cuff 24 has a preferred inside diameter of about 1.5 inches in its relaxed state as shown. The other end of cuff 24 at which it connects to end 16 has a preferred inside diameter of about 2.5 inches to accommodate most nozzles of portable hair dryers. The illustrated relaxed portion of cuff 24 is capable of stretching to the preferred inside diameter of about 2.5 inches.

A looped strap 26 has one end fixedly connected to cuff 24, and an opposing free end. Strap 26 is preferably an elastic fabric, and can be the same as or different than the fabric of cuff 24, as long as it is suitably strong to secure a portable dryer as is discussed further below. The loop defined by strap 26 should, of course, be of a suitable size to receive the portable dryer therein. Although strap 26 is shown as connected to cuff 24 in the illustrated embodiment, such strap could be connected directly to end 16 if desired.

An additional strap 28 is preferably provided to receive a cord extending from a portable dryer through a loop formed at one end. The other end is shown as being fixedly connected by any suitable means to body portion 12. Strap 28 is preferably comprised of Mylar® polyester film or vinyl.

In preparation for using the embodiment of FIG. 1 in drying and removing wrinkles from a button-up shirt, inflatable member 10 is first hung by hook 20 from a suitable fixed member at the desired height, such as a shower or clothes hanging rod or the upper portion of the trim around a doorway. In this hanging orientation, end 16 will be directly below end 14. Clip 22 is then connected to the rear portion of the collar of the shirt hold the shirt in place while fitting inflatable member 10 within the shirt. Arms **12*b* are accordingly inserted and pulled through the sleeves of the shirt, and the shirt is wrapped around torso 12*a* and buttoned. Of course, the shirt could be a buttonless shirt, such as a T-shirt, in which case the shirt would be pulled over inflatable member 10 prior to hanging. To speed up the drying process for a short sleeved shirt, a portion of each arm 12*b*** can be tied off by an appropriate means so as to not permit air to flow into such arm portion.

After inflatable member 10 is hung and the shirt fitted over such member, a portable dryer, of the type having a handle, an internal fan, and a nozzle from which heated air is blown (normally used for drying hair), is secured in position in preparation for inflation. The nozzle of the dryer is inserted into and through cuff 24 so that the cuff sealingly engages at least a portion of the nozzle, which as positioned is in communication with the interior of inflatable member 10. Strap 26 is placed around and in engagement with the dryer to secure it in a fixed position relative to inflatable member 10. The electric cord that typically extends from the dryer can be fed through the loop of strap 28 to assist in stabilizing the dryer in its desired position with its handle substantially horizontal and its nozzle substantially vertical. The dryer can now be turned on to initiate a continuous flow of heated air into inflatable member 10. Most portable dryers of the type described above have a low and a high setting. A setting is selected which gives the necessary inflation and which dries the shirt at the desired rate. The low setting would typically be selected when drying a shirt of a delicate fabric. A high setting could be used with, for example, a T-shirt composed of a durable fabric such as cotton. For even more control, a rheostat controller (not shown) could be connected between the electrical outlet and the dryer.

After the dryer is turned on, inflatable member 10 typically inflates quickly. The continuous flow of heated air into inflatable member 10 maintains the member in an inflated state by means of the air permeability of the fabric of body portion 12. The particular air permeability values discussed previously have been found to maintain the desired inflated state when using a portable dryer of the type described above, which normally supplies a flow of heated air at a flow rate of about 10 to about 25 $ft^3$/min (cubic feet per minute).

Figure 2:
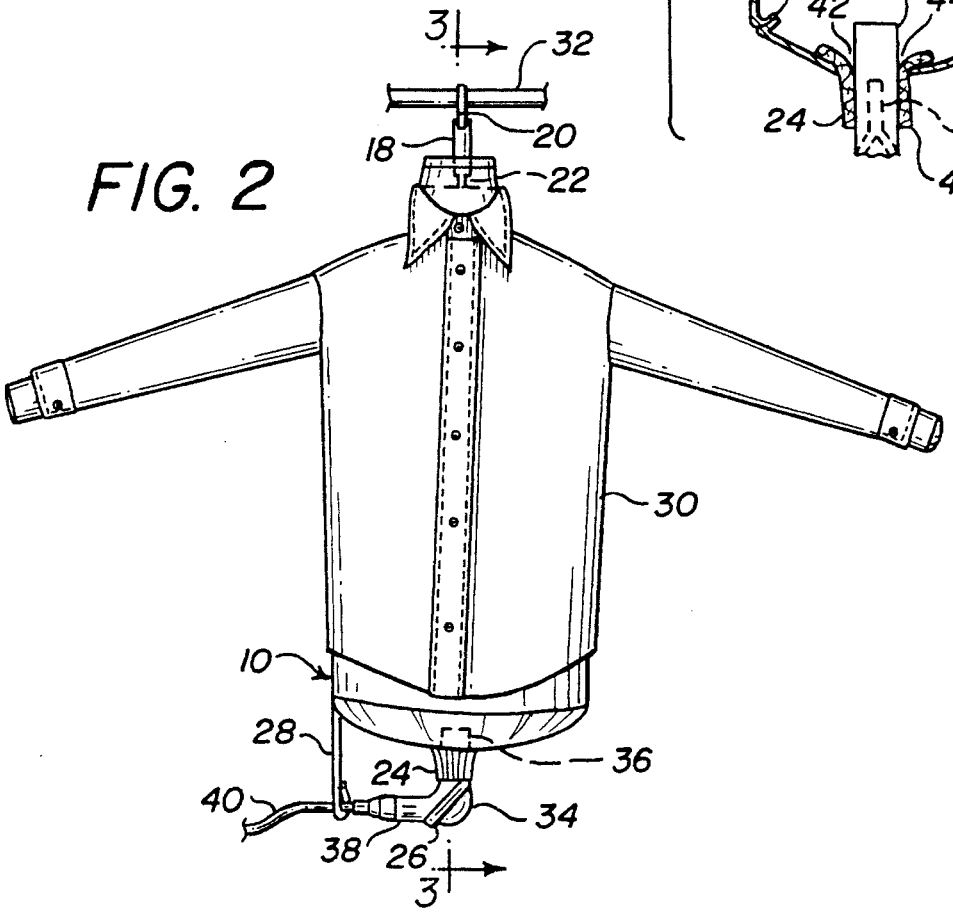
FIG. 2 is a front view of the embodiment of FIG. 1 with its inflatable member in an inflated state while drying and removing wrinkles from a shirt.

Referring now to FIG. 2, the embodiment of FIG. 1 is shown in use for drying and removing wrinkles from a shirt. Inflatable member 10, in its inflated state and as fitted within shirt 30, is shown as hanging from a rod 32. Portable dryer 34, having a nozzle 36, a handle 38, and an electric cord 40, is also shown as secured in its desired position during use. Drying time depends upon the dampness of the shirt, its particular fabric, and the dryer setting selected, but a time in the range of about 5 to about 15 minutes is typical. Dryer 34 is then turned off and removed, followed by removal of shirt 30 from inflatable member 10. Shirt 30 will be dry and substantially wrinkle-free.

Figure 3:
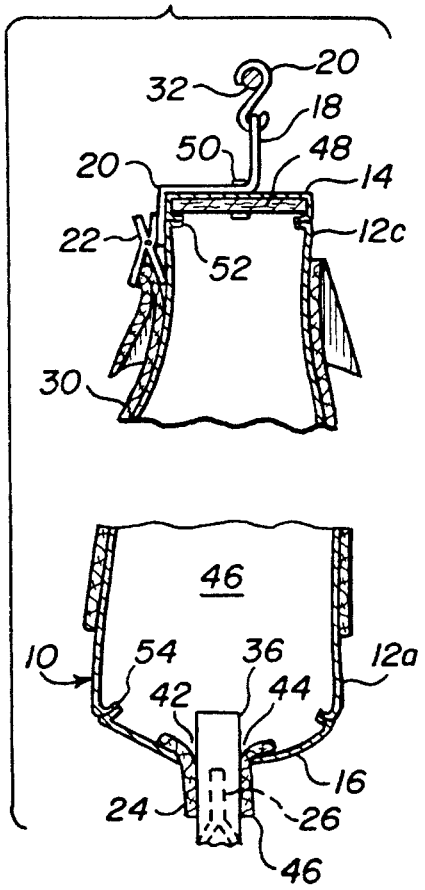
FIG. 3 is a fragmentary cross-sectional view as viewed along line 3—3 in FIG. 2.

Referring now to FIG. 3, this cross-sectional view shows opening 42 at end 16, and further shows cuff 24 as being a hollow member having an open end 44, connected to end 16 at opening 42, and an opposing end 46. Open end 4 is preferably sewn to end 16 so as to prevent direct contact of nozzle 36 with the fabric of end 16. Nozzle 36 is in sealing engagement with cuff 24 and extends through opening 42 and open end 44. Nozzle 36 thereby extends into the interior 46 of inflatable member 10 so that the outlet of the nozzle is in communication with interior 46. Of course, nozzle 36 could be shorter than the particular nozzle shown in FIG. 3, in which case the outlet of such nozzle could be positioned within cuff 24, but still in communication with interior 46 through opening 42. One end of strap 26 (shown in broken lines) is connected, preferably sewn, to the inner surface of cuff 24. A disk 48 of any suitably rigid and heat resistant material, such as stiff cardboard, is fixedly connected to end 14 by a fastener 50, which also secures straps 18 and 20 to end 14. A particularly suitable fastener for use as fastener 50 is a "dome and tack" type fastener, available from Microplastics, Inc. of Flippin, Ark. As shown, clip 22 is fastened to the collar of shirt 30 to assist the user in fitting shirt 30 over inflatable member 10. Clip 22 may remain fastened to the collar throughout the drying process if desired. Finally, FIG. 3 shows internal seams 52 and 54, and the interior surface of shirt 30 as being in contact with the exterior surface of body portion 12 when inflatable member 10 is an inflated state.

Figure 4:
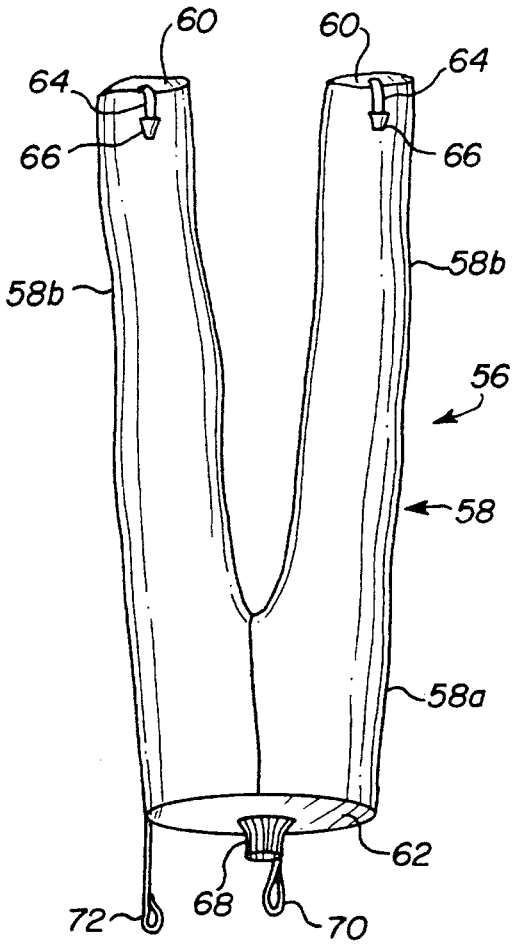
FIG. 4 illustrates another embodiment of the invention having an inflatable member in the shape of a pair of pants and shown in an uninflated state.

Referring now to FIG. 4, another embodiment of the invention is shown, which is for drying and removing wrinkles from a pair of pants. Inflatable member 56 has a body portion 58 and opposing ends 60 and 62 between which the body portion extends. As shown, body portion 58 has a trunk **58*a* and legs 58*b*, and is accordingly shaped and sized to fit within a pair of pants. Each of straps 64 has one end fixedly connected to a respective end 60, and an opposing free end having a clip 66 fastened thereto. The embodiment of FIG. 4 is similar to the embodiment of FIG. 1 in other respects. The fabrics employed for the body portion and ends can be as described above. Cuff 68, looped strap 70, and strap 72 are provided in the same manner as in FIG. 1**.

In preparation for using the embodiment of FIG. 4, a pair of pants is first hung up with a suitable pants hanger, followed by insertion of legs **58*b* into and through the pant legs. The cuffs of the pant legs are then connected to clips 66 and the portable dryer is secured in position to begin inflation of inflatable member 56. Clips 66 and associated straps 64 assist in holding inflatable member 56 in place during positioning of the dryer and during inflation. However, during inflation a user may need to adjust the positions of ends 60 upwardly due to the weight of the dryer. Or, the user can support the weight of the dryer during inflation. After inflation is completed, inflatable member 56** will stay in position without any need for further adjustment.

Figure 5:
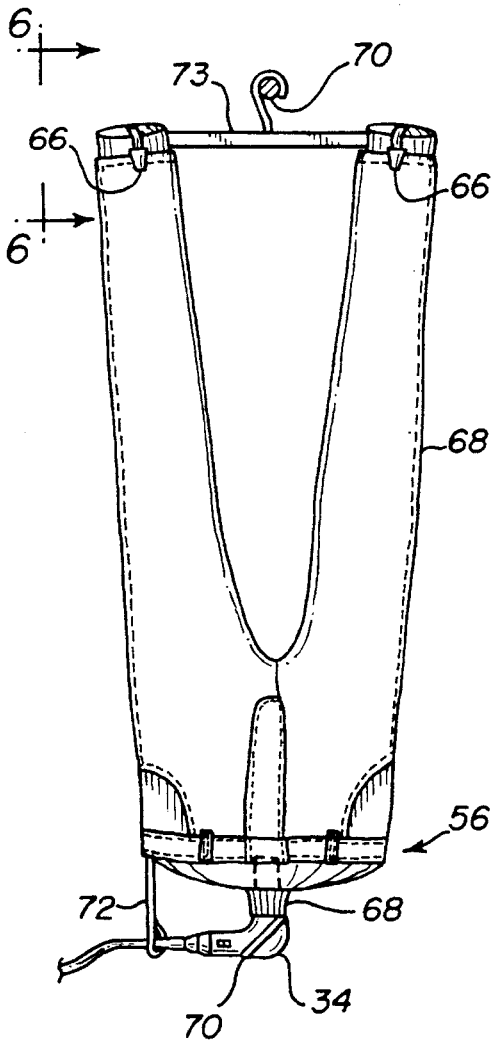
FIG. 5 shows the embodiment of FIG. 4 with its inflatable member in an inflated state while drying and removing wrinkles from a pair of pants.

Referring now to FIG. 5, the embodiment of FIG. 4 is shown with inflatable member 56 in its inflated state and as fitted within a pair of pants 68. Pants 68 are hung from a rod 70 by a hanger 73, as is more clearly shown in FIG. 6. Clips 66 are shown as being connected to the cuffs of pants 68. The dryer shown in FIG. 5, dryer 34, is the same dryer used in FIG. 2. Drying and wrinkle removal is achieved in the same manner as discussed above.

Figure 6:
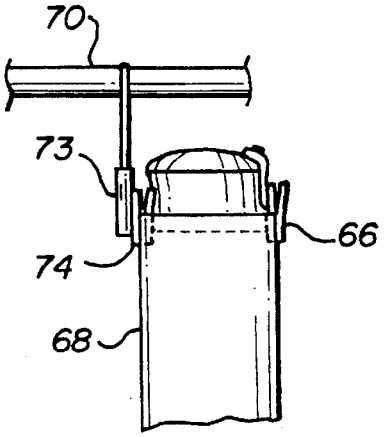
FIG. 6 is a fragmentary side view as viewed along line 5—5 in FIG. 5.

Referring now to FIG. 6, this FIGURE more clearly shows the manner in which hanger 73 is connected to pants 68. Hanger 73 is preferably the type having clips 74, which are connected to the side of each pant cuff opposite the side where clip 66 is connected.

Figure 7:
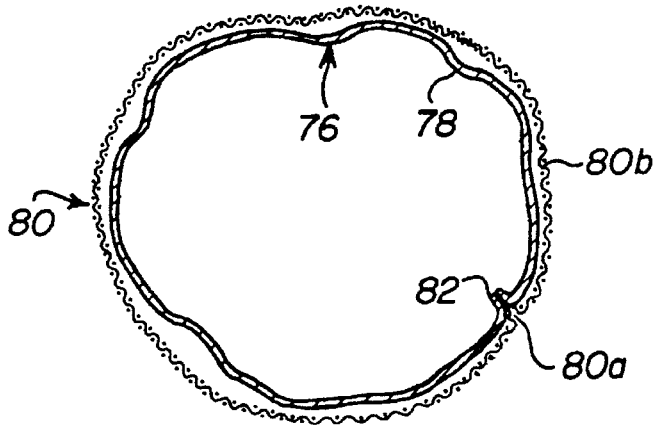
FIG. 7 is a transverse cross-sectional view of yet another embodiment of the invention employing a substantially cylindrical inflatable member, shown in an uninflated state, and a flexible member connected to the inflatable member.

Referring now to FIG. 7, a transverse cross-sectional view of another embodiment is shown. This embodiment includes an inflatable member 76, of which body portion 78 is shown in cross section and in an uninflated state. Body portion 78 is preferably substantially cylindrical in shape and comprised of the same fabric as the body portion of the FIG. 1 embodiment. A flexible member 80 has a connecting portion **80*a* and an air permeable jacket portion 80*b*. Connecting portion 80*a* is preferably fixedly connected to body portion 78 of inflatable member 76 along an internal sewn seam 82. Jacket portion 80*b* is shaped like body portion 78 and has an inside diameter about the same as the outside diameter of body portion 78. Flexible member 80** is preferably netting or mesh material, most preferably nylon, having mesh openings of preferably about 1/16 to about 1/4 inch.

In preparation for use in drying and removing wrinkles from miscellaneous articles of clothing such as shorts, underwear, socks, etc., the articles are positioned between jacket portion **80*b* and body portion 78 after partial inflation of inflatable member 76. Inflation is then completed so as to removably secure the articles between jacket portion 80*b* and body portion 78 with surfaces of the articles in contact with the exterior surface of body portion 78**.

Figure 8:
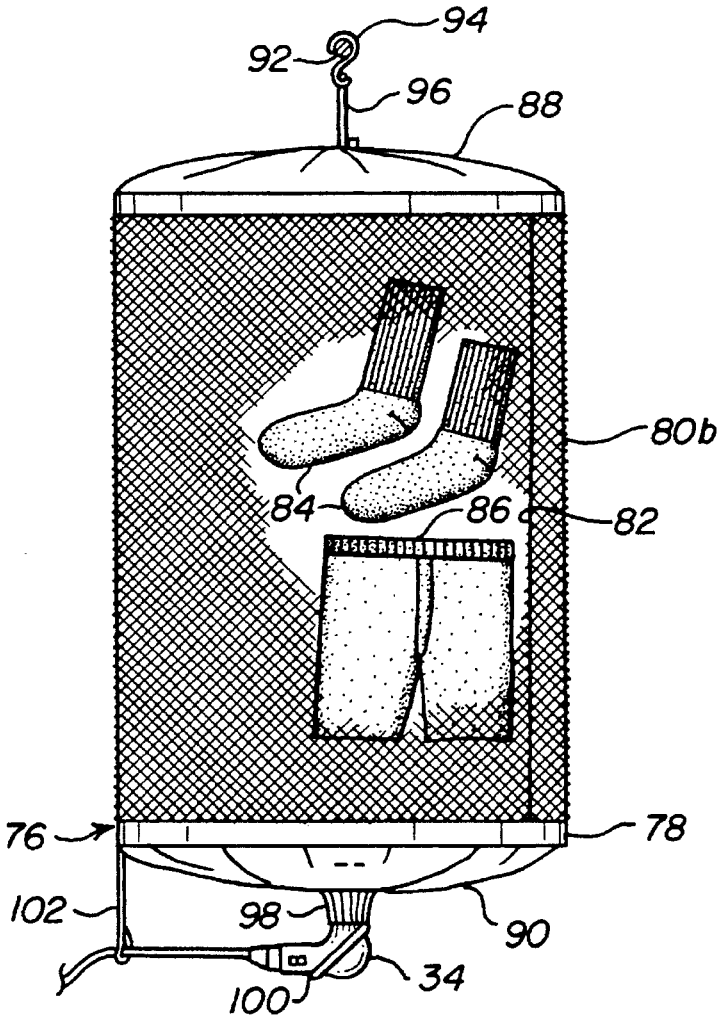
FIG. 8 illustrates the embodiment of FIG. 7, having its inflatable member in an inflated state while drying and removing wrinkles from miscellaneous articles of clothing secured between the inflatable member and flexible member.

Referring now to FIG. 8, this view of the FIG. 7 embodiment shows a pair of socks 84 and a pair of shorts 86 secured in position after inflation of inflatable member 76. A portion of jacket portion **80*b* is broken away to more clearly reveal the articles of clothing. Inflatable member 76 can be seen to include ends 88 and 90 between which body portion 78 extends. Inflatable member 76 is hung from a rod 92 by means of a hook 94 and strap 96, which is connected to end 88. A cuff 98, looped strap 100, and strap 102 are provided in the same manner as in FIG. 1. Dryer 34 (same dryer as used in FIG. 1) is shown as secured in position during use. Drying and wrinkle removal is achieved in the manner discussed above, followed by turning off the dryer to result in deflation of inflatable member 76 and release of socks 84 and shorts 86 from their secured position between jacket portion 80*b* and body portion 78**.

Obviously, many modifications and variations of the present invention are possible in light of the above teachings. For example, with regard to the aspect of the invention wherein the inflatable member is fitted within the article of clothing, the inflatable member could be shaped to fit within articles other than the illustrated pants and shirt, such as a dress or skirt. Or, although the illustrated embodiments employ an inflatable member hung from an upper end, and a portable dryer secured to a lower end, the dryer could be secured to the upper end. However, securing the dryer at the lower end is preferred as being a more stable configuration. It is, therefore, to be understood that within the scope of the appended claims, the invention can be practiced otherwise than as specifically described.

Several examples will now be described to further illustrate the invention. These examples should not be construed to limit the invention in any manner. In each example, the inflatable member is made entirely of Exacta-Chute™ nylon fabric, available from Performance Textiles, Inc. of Greensboro, N.C. Such fabric is air permeable and has an air permeability of no more than 3 $ft^3/min/ft^2$, as achieved by a calendering process described previously. Determination of the air permeability was by above-mentioned Federal Standard 191A, Method 5450. The fabric is further characterized by the following specifications, where test methods are in parentheses and "Fed." is understood to refer to Federal Standard 191A: 30 denier, high tenacity, bright nylon fibers (Fed. Method 1530); a warp and fill twist (Fed. Method 4050); a melting point of 489° F. or −10° F. (Fed. Method 1534); a rip stop weave pattern with 7.5 minimum repeats per inch (visual); a weight (max.) of 1.17 $oz/yd^2$ (Fed. Method 5041); a thickness (max.) of 0.003 inch (Fed. Method 5030); a strength (min., 1 inch strip) of 47×47 pounds (Fed. Method 5104); an elongation (min.) of 25% (Fed. Method 5104); a tear strength (min.) of 5×5 pounds (ASTM Method D 2261 or 2262 (1983)); a construction (min.) of 130×132 (Fed. Method 5050); a pH of 6.0–8.0 (Fed. Method 2811); a heat/light resistance of max. 25% change (MILC 44378, Para. 4.5.3.1 light and Para. 4.5.3.2 heat); and a bias (max.) of 2 inches on 48 inch wide fabric and 2.5 inches on 64 inch wide fabric (Fed. Method 5060). The nozzle cuff as attached to each inflatable member is made of a knitted fabric composed of acrylic, polyester, and spandex. The looped strap for securing the portable dryer is a similar elastic fabric. Each example employs a Vidal Sassoon Model VS725 portable hair dryer having a low and a high setting. This model of dryer supplies a flow of heated air from its nozzle at a flow rate of about 14.2 to about 17.4 $ft^3/min$, depending upon which setting is selected. Temperature readings are taken with a Cenco #19305 thermometer.

EXAMPLE 1

The run of this example employed a device substantially like the embodiment of FIG. 1, except that a looped cord instead of a strap and hook was used to hang the inflatable member. A damp cotton, button-up shirt was taken directly out of a washing machine and fitted around the hanging inflatable member. The portable hair dryer was secured in position as shown in FIG. 2, and turned on at the low setting. The thermometer was placed between the inflatable member and shirt about pocket high. The temperature after 10 minutes was 120° F., and the shirt was dry and substantially wrinkle-free. The dryer was then turned to the high setting, and temperature readings were taken at 15 minutes and 25 minutes into the run. The temperature readings were identical at 175° F.

EXAMPLE 2

The same device, shirt, and portable hair dryer as described in Example 1 were employed in the run of this example after the run of Example 1 was completed and the inflatable member had cooled to room temperature. A rheostat controller was connected between the dryer and electrical outlet. With the rheostat turned off, the dryer was turned on at the high setting. A dial on the rheostat was gradually turned until the fan motor in the dryer began to run. The dial was then turned until the inflatable member was inflated and such inflated state was maintained. The thermometer was then placed between the inflatable member and shirt, and readings were taken after 5 and 10 minutes.

Each reading was 105° F. The rheostat was then turned slightly to increase the current to the dryer to thereby increase the speed of the dryer fan motor and increase the heat supplied by the dryer heating element. Readings were again taken at 15 minutes and 25 minutes into the run. Each reading was 128° F. The rheostat was turned further, and additional readings were taken at 30 minutes and 40 minutes into the run. Each reading was 158° F. The rheostat dial was then turned to its maximum setting, and readings were taken at 45 minutes and 55 minutes into the run. Each reading was 175° F. The above results demonstrate the range of temperatures typical during use of the invention.

EXAMPLE 3

The run of this example employed a device substantially like the embodiment of FIG. 4, but without the clips. A pair of washed jeans that had been spun dry were hung, and the inflatable member was fitted within the jeans. The dryer was then secured in position and turned on at the low setting. After 5 minutes, the thermometer was placed between the inflatable member and the jeans 4 inches from the top of the waist, and a reading was taken at 10 minutes into the run. The reading was 118° F. The dryer was then switched to the high setting and another temperature reading was taken at 20 minutes into the run. The reading was 168° F. The jeans were observed to be dry and substantially wrinkle-free.

EXAMPLE 4

This example employed a device substantially like the embodiment of FIGS. 7 and 8, using a nylon netting and an inflatable member having a length of 30 inches and a diameter of 16 inches. The inflatable member was hung and the dryer secured in position. The dryer was turned on at the low setting. The thermometer was placed between the inflatable member and nylon netting 4 inches from the top of the inflatable member. The thermometer indicated 122° F. after 10 minutes. The dryer was then switched to the high setting, and a temperature reading was taken at 20 minutes into the run. The reading was 182° F. Thus, the temperature readings are very similar to those of Example 1.

That which is claimed is:

1. A portable device for drying and removing wrinkles from an article of clothing, which is for use with a portable dryer of the type having a handle, internal fan, and nozzle from which heated air is blown, wherein the device comprises:

an inflatable member having an interior and opposing first and second ends, the first end having an opening in communication with the interior, and further having a body portion extending between the first and second ends and comprised of an air permeable fabric which has an exterior surface and which is sized and shaped to fit within the article;

a hanging means fixedly connected to the second end of the inflatable member for hanging the inflatable member in a hanging orientation with the first end directly below the second end;

a sealing means associated with the opening for sealingly engaging the nozzle so that the nozzle is in communication with the interior of the inflatable member through the opening;

a fastener means for securing the portable dryer in a fixed position relative to the inflatable member at the same time that the sealing means is in engagement with the nozzle and the inflatable member is in a hanging orientation, wherein the fastener means comprises a looped strap having one end fixedly connected to the sealing means or the first end of the inflatable member, and further having an opposing free end, whereby the looped strap can be positioned around and in engagement with the portable dryer to secure it in position;

wherein the fabric has an air permeability that permits inflating the inflatable member to an inflated state and maintaining such inflated state by means of a continuous flow of heated air into the interior of the inflatable member from the nozzle of the portable dryer, when the nozzle is in sealed engagement with the sealing means and is secured in position by the fastener means, and wherein the article has an interior surface, whereby the inflatable member in said hanging orientation with its body portion within the article, and as maintained in the inflated state, has the exterior surface of its body portion in contact with the interior surface of the article so as to effectively dry and remove wrinkles from the article.

2. A device as recited in claim 1 wherein the fabric has an air permeability of no more than about 100 $ft^3/min/ft^2$.

3. A device as recited in claim 2 wherein the fabric has an air permeability of no more than about 10 $ft^3/min/ft^2$.

4. A device as recited in claim 3 wherein the fabric has an air permeability of no more than about 3 $ft^3/min/ft^2$.

5. A device as recited in claim 4 wherein the fabric has an air permeability of about 1 to about 3 $ft^3/min/ft^2$.

6. A device as recited in claim 5 wherein the fabric is woven and is comprised of nylon fibers.

7. A device as recited in claim 6 wherein the fibers have a fineness of about 20 to about 70 denier, and the fabric has a weight of about 0.5 to about 6 $oz/yd^2$ and a thickness of about 0.002 to about 0.15 inch.

8. A portable device for drying and removing wrinkles from an article of clothing, which is for use with a portable dryer of the type having a handle, internal fan, and nozzle from which heated air is blown, wherein the device comprises:

an inflatable member, capable of being hung in at least one hanging orientation, having an interior and opposing first and second ends comprising a first air permeable fabric, the first end having an opening in communication with the interior, and further having a body portion extending between the first and second ends and comprised of a second air permeable fabric which has an exterior surface and which is sized and shaped to fit within the article, wherein the first air permeable fabric has a heavier weight and a lower air permeability than the second air permeable fabric;

a sealing means associated with the opening for sealingly engaging the nozzle so that the nozzle is in communication with the interior of the inflatable member through the opening;

a fastener means, fixedly connected to the inflatable member or the sealing means, for securing the portable dryer in a fixed position relative to the inflatable member at the same time that the sealing means is in engagement with the nozzle and the inflatable member is in a hanging orientation;

wherein the first and second fabrics have air permeabilities that permit inflating the inflatable member to an inflated state and maintaining such inflated state by means of a continuous flow of heated air into the interior of the inflatable member from the nozzle of the portable dryer, when the nozzle is in sealed engagement with the sealing means and is secured in position by the fastener means, and wherein the article has an interior surface, whereby the inflatable member in said hanging orientation with its body portion within the article, and as maintained in the inflated state, has the exterior surface of its body portion in contact with the interior surface of the article so as to effectively dry and remove wrinkles from the article.

9. A device as recited in claim 8 wherein the sealing means comprises a flexible hollow member having an open end connected to the first end of the inflatable member at the opening, and further having an opposing open end into which the nozzle can be inserted such that the hollow member sealingly engages at least a portion of the nozzle.

10. A portable device for drying and removing wrinkles from an article of clothing, which is for use with a portable dryer of the type having a handle, internal fan, and nozzle from which heated air is blown, wherein the device comprises:

an inflatable member, capable of being hung in at least one hanging orientation, having an interior and an opening in communication with the interior, and further having a body portion comprised of an air permeable fabric which has an exterior surface and which is sized and shaped to fit within the article;

a sealing means associated with the opening for sealingly engaging the nozzle so that the nozzle is in communication with the interior of the inflatable member through the opening;

a fastener means, fixedly connected to the inflatable member or the sealing means, for securing the portable dryer in a fixed position relative to the inflatable member at the same time that the sealing means is in engagement with the nozzle and the inflatable member is in a hanging orientation;

wherein the fabric has an air permeability of no more than about 10 $ft^3/min/ft^2$, which permits inflating the inflatable member to an inflated state and maintaining such inflated state by means of a continuous flow of heated air into the interior of the inflatable member from the nozzle of the portable dryer, when the nozzle is in sealed engagement with the sealing means and is secured in position by the fastener means, and wherein the article has an interior surface, whereby the inflatable member in said hanging orientation with its body portion within the article, and as maintained in the inflated state, has the exterior surface of its body portion in contact with the interior surface of the article so as to effectively dry and remove wrinkles from the article.

11. A portable device as recited in claim 10 wherein the fabric has an air permeability of no more than about 3 $ft^3/min/ft^2$.

12. A portable device for drying and removing wrinkles from at least one article of clothing, which is for use with a portable dryer of the type having a handle, internal fan, and nozzle from which heated air is blown, wherein the device comprises:

an inflatable member, capable of being hung in at least one hanging orientation, having an interior and an opening in communication with the interior, and further having a body portion comprised of an air permeable fabric which has an exterior surface;

a sealing means associated with the opening for sealingly engaging the nozzle so that the nozzle is in communication with the interior of the inflatable member through the opening;

a fastener means, fixedly connected to the inflatable member or the sealing means, for securing the portable dryer in a fixed position relative to the inflatable member at the same time that the sealing means is in engagement with the nozzle and the inflatable member is in a hanging orientation;

a flexible member having a connecting portion for providing a connection to the inflatable member and an air permeable jacket portion which is shaped and sized to allow, when the inflatable member is in an inflated state, the article to be positioned and removably secured between the jacket portion and the body portion with at least one surface of the article in contact with the exterior surface of the body portion;

wherein the fabric has an air permeability that permits inflating the inflatable member to the inflated state and maintaining such inflated state by means of a continuous flow of heated air into the interior of the inflatable member from the nozzle of the portable dryer, when the nozzle is in sealed engagement with the sealing means and is secured in position by the fastener means, whereby the inflatable member in said hanging orientation and as maintained in its inflated state effectively dries and remove wrinkles from the article secured between the jacket portion and body portion.

13. A device as recited in claim 12 wherein the body portion of the inflatable member is substantially cylindrical in shape.

14. A device as recited in claim 13 wherein the flexible member comprises a nylon netting.

15. A device as recited in claim 14 wherein the fabric has an air permeability of no more than about 100 $ft^3/min/ft^2$.

16. A device as recited in claim 15 wherein the fabric has an air permeability of no more than about 3 $ft^3/min/ft^2$.

17. A device as recited in claim 16 wherein the fabric is woven and is comprised of nylon fibers.

18. A device as recited in claim 17 wherein the inflatable member also has first and second opposing ends between which the body portion extends, the first end having the opening therethrough, and wherein the device further comprises a hanging means fixedly connected to the second end for hanging the inflatable member in an orientation with the first end directly below the second end.

19. A device as recited in claim 18 wherein the sealing means comprises a flexible hollow member having an open end connected to the first end of the inflatable member at the opening, and further having an opposing open end into which the nozzle can be inserted such that the hollow member sealingly engages at least a portion of the nozzle.

20. A device as recited in claim 19 wherein the fastener means comprises a looped strap having one end fixedly connected to the sealing means or the first end of the inflatable member, and further having an opposing free end, whereby the looped strap can be positioned around and in engagement with the portable dryer to secure it in position.

* * * * *